US005129646A

United States Patent [19]

Miyakawa

[11] Patent Number: 5,129,646

[45] Date of Patent: Jul. 14, 1992

[54] RECORDING APPARATUS HAVING A REMOVABLE SHEET FEEDER

[75] Inventor: Akira Miyakawa, Tokyo, Japan

[73] Assignee: Canon Kabushiki Kaisha, Tokyo, Japan

[21] Appl. No.: 668,685

[22] Filed: Mar. 7, 1991

Related U.S. Application Data

[63] Continuation of Ser. No. 366,277, Jun. 13, 1989, abandoned, which is a continuation of Ser. No. 73,437, Jul. 15, 1987, abandoned.

[30] Foreign Application Priority Data

Jul. 18, 1986 [JP] Japan ..... 61-169366
Jul. 18, 1986 [JP] Japan ..... 61-169367

[51] Int. Cl.[5] ..... B65H 5/02

[52] U.S. Cl. ..... 271/273; 271/3; 271/162; 400/625; 400/629; 400/636.2; 400/647

[58] Field of Search ..... 271/3, 4, 9, 109, 110, 271/111, 37, 162, 164, 272, 273, 274; 400/624, 625, 629, 604, 636.2, 605, 646, 647; 16/118; 74/553, 558.5, 558; D8/300, 301, 307, 309, 312, 313, 315

[56] References Cited

U.S. PATENT DOCUMENTS

| | | | |
|---|---|---|---|
| 2,667,084 | 1/1954 | MacNamara | 74/504 |
| 2,863,968 | 12/1958 | Trautman | 16/118 X |
| 3,318,169 | 5/1967 | Tronslien | 74/432 |
| 4,000,539 | 1/1977 | Neyer | 16/121 |
| 4,387,889 | 6/1983 | Koyama et al. | 271/162 X |
| 4,560,295 | 12/1985 | Fujiwara et al. | 400/637.1 |
| 4,565,360 | 1/1986 | Runzi | 400/625 X |
| 4,619,388 | 10/1986 | Ono et al. | 400/624 X |
| 4,655,626 | 4/1987 | Okazaki | 400/605 |
| 4,688,957 | 8/1987 | Prevignano | 400/647 X |
| 4,699,366 | 10/1987 | Kashimura et al. | 400/625 X |

FOREIGN PATENT DOCUMENTS

| | | | |
|---|---|---|---|
| 2919796 | 5/1979 | Fed. Rep. of Germany . | |
| 2856570 | 7/1979 | Fed. Rep. of Germany . | |
| 3319490 | 10/1983 | Fed. Rep. of Germany . | |
| 59-78875 | 5/1984 | Japan | 400/605 |
| 358915 | 10/1931 | United Kingdom . | |
| 2011321 | 12/1978 | United Kingdom . | |

*Primary Examiner*—David H. Bollinger
*Attorney, Agent, or Firm*—Fitzpatrick, Cella, Harper & Scinto

[57] ABSTRACT

A recording apparatus on which a cut sheet feeder is removably mountable includes an outer case, a feed roller contained in the outer case and rotatable by the power of a drive source, a pinch roller urged against or spaced apart from the feed roller, and a controlling device exposed out of the outer case and engageable with the cut sheet feeder to forcibly control the pinch roller into a state in which it is urged against the feed roller. The cut sheet feeder has a first stacker piling thereon cut sheets to be fed to the recording apparatus, a second stacker piling thereon cut sheets discharged from the recording apparatus, and a controlling device for forcibly controlling the pinch roller into its urged state when the cut sheet feeder is mounted on the recording apparatus.

10 Claims, 6 Drawing Sheets

RECORDING APPARATUS HAVING A REMOVABLE SHEET FEEDER

This application is a continuation of application Ser. No. 366,277, filed Jun. 13, 1989, which was a continuation of application Ser. No. 073,437, filed Jul. 15, 1987, both now abandoned.

BACKGROUND OF THE INVENTION

1. Field of the Invention

This invention relates to a cut sheet feeder for automatically feeding cut sheets and to a recording apparatus using the same.

2. Related Background Art

A cut sheet feeder is for automatically supplying cut sheets or the like to a recording apparatus, and it is a device which eliminates the operation of manually inserting sheets (recording mediums such as printing paper and plastic sheets), thereby improving the operability of the recording apparatus and mitigating the user's burden.

As cut sheet feeders of this type, use has widely been made of a device of the type which is not provided with its own drive source (a motor or the like) in its body and neither provided with an electrical output source indicative of its own presence (the state in which it is connected and usable), that is, a device of relatively low cost.

On the other hand, a recording apparatus such as a printer has various sheet conveying functions so as to correspond to various types of sheets (recording mediums) such as cut sheets, continuous paper, continuous paper adapted to be conveyed by a sprocket or the like (pin feed) and continuous paper adapted to be friction-fed by a friction roller or the like.

The user, when utilizing a recording apparatus, selects and uses a sheet conveying function corresponding to the type of sheets (recording mediums).

If the user commits a mistake in the selection, for example, commits an error of using the friction feed and the pin feed together, irregularity occurs in the sheet feeding pitch or sheet jam occurs.

The recording apparatus is designed such that when the user selects the pin feed, the friction roller or the like is retracted so that the other friction feed function does not affect the sheets.

Heretofore, design has been made such that when the cut sheet feeder is connected to the recording apparatus, the recording apparatus side is selected to the friction feed mode on the part of the user and a sheet fed from the feeder is nipped between friction rollers and directed into the recording apparatus. In such case, if the pin feed mode is selected, the sheet will not be introduced into the recording apparatus even if an effort is made to feed the sheet from the feeder into the recording apparatus.

The operation of selecting the friction feed and the pin feed has usually been accomplished by the change-over operation using a release lever or the like provided in the recording apparatus body.

In some recording apparatuses of high added value, even if the user does not manually move the release lever, power is obtained from a drive source such as a motor by a soft command or some selection signal to forcibly move the friction rollers back and forth, but such a construction has suffered from a problem that the cost becomes very high and the product becomes expensive.

From the fact that as previously described, when the cut sheet feeder is used, only the friction feed functions effectively and therefore the change-over of the release lever or the like is unnecessary and the fact that since the prior-art recording apparatus of this type is often personally used on a desk, the configuration and dimensions thereof are designed as compactly as possible, the release lever, etc. are often hidden in the interior of the feeder in a state in which the cut sheet feeder is placed on and connected to the recording apparatus.

There are devices in which the release lever, etc. are compulsorily disposed outside the feeder to enable the presence thereof to be readily confirmed, but they are not preferable in appearance.

On the other hand, it is often the case with devices in which the release lever is hidden in the interior of the feeder that the position of the release lever cannot be confirmed.

Therefore, when the user connects the feeder to the recording apparatus while forgetting to change over the feeder to the friction feed mode, abnormality is not noticed until trouble such as unsatisfactory feed occurs after the first sheet has been fed from the feeder, and the feeder must be removed and reset after it has been found that the cause of the trouble is the misoperation of the release lever, and this has meant a problem that handling becomes cumbersome.

Also, in a recording apparatus such as a printer, a facsimile apparatus or a typewriter, there is a case where a continuous sheet such as rolled paper or fan-folded paper is used as a recording medium such as printing paper or plastic sheet, and a case where cut sheets are used as such recording medium.

Generally, where a continuous sheet is used, it may be set only once and thereafter recording can be continuously effected thereon, and this is convenient to the user, while in the case of cut sheets, they must be manually set one by one, and this has led to an inconvenience that the cut sheets must be always monitored, which has also meant low efficiency of office work.

Usually, a recording apparatus is provided with a sheet feeding knob for manually rotating a sheet feed roller when manually setting cut sheets. Accordingly, the work of manually setting cut sheets one by one has been done in the procedures of inserting a sheet from the sheet insertion port of the recording apparatus and pushing it into a location at which it contacts the peripheral surface of the sheet feed roller (usually a portion against which the pinch roller is urged), and thereafter manually operating the sheet feeding knob to rotate the sheet feed roller by a suitable angle, thereby setting the sheet at a desired leading position.

Referring to FIG. 1 of the accompanying drawings which shows an example of the recording apparatus of this type, a sheet feeding knob 1 is mounted in a half-embedded state in which it is incorporated into the recording apparatus body and partly protrudes from the upper surface of a case 2.

Referring now to FIG. 2 of the accompanying drawings which shows another example of the recording apparatus having a sheet feeding knob, the sheet feeding knob 3 is mounted in a state in which it is exposed out of the case 4 of the recording apparatus so as to be able to be grasped by a hand.

The sheet feeding knobs 1 and 3 of FIGS. 1 and 2, respectively, are directed only to the manual feeding of sheets and therefore, shallow grooves for anti-slippage are merely provided on the peripheral surface thereof. These shallow grooves are formed in such a manner that the user does not feel any pain when he or she touches the knob, and usually are at a thin pitch.

Particularly, in the case of the half-embedded type sheet feeding knob 1 of FIG. 1, as compared with a knob which can be grasped over the full periphery (for example, the knob 3 of FIG. 2), the peripheral surface thereof is pushed and rotated by a fingertip and thus a considerable force is applied to the fingertip and accordingly, more consideration has been given so as to prevent the fingertip from feeling pain.

On the other hand, in order to give up manually feeding sheets and improve the usability when cut sheets are used, means is adopted for placing a cut sheet feeder as an option on a recording apparatus and connecting it to the latter for operative association therewith, and making it possible to automatically feed and discharge the cut sheets one by one.

Such cut sheet feeder may be divided broadly into the type in which the feeder itself is equipped with its drive source depending on the degree of requirement and the capability of a recording apparatus and the type which is always under the control of a recording apparatus and in which the driving power is provided from the recording apparatus.

Further, with regard to the latter type, there have been proposed a device in which a gear exclusively for use as transmission means for driving the feeder is particularly provided in the recording apparatus, a device in which power is obtained from rotation of the sheet feed roller of the recording apparatus by a friction force, and a device in which, from the viewpoints of space and arrangement, power is obtained through a sheet feeding knob for manually rotating the sheet feed roller of the recording apparatus.

Where the drive force of the cut sheet feeder is transmitted through the sheet feeding knob as previously described, a gear is formed on the outer periphery of the sheet feeding knob and this gear is brought into meshing engagement with a gear in the feeder, whereby transmission of power is accomplished.

FIGS. 3 and 4 of the accompanying drawings illustratively show conventional sheet feeding knobs serving also as the power transmitting gear.

In the sheet feeding knob 5 of FIG. 3, it has been necessary to satisfy the following conditions in order to realize the function of a manually operated knob for the sheet feed roller and the function of a power transmitting gear on the same outer peripheral surface:

(i) The outer diameter of a gear 6 becomes greater to keep the co-usability thereof with the sheet feeding knob 5;

(ii) Reliable meshing engagement is necessary and the tooth form of the gear 6 becomes larger to secure the ease of mounting and dismounting; and (iii) Because the knob is rotated by fingers, the axial dimensions thereof are necessary and the width thereof becomes greater.

To satisfy these conditions, in the conventional sheet feeding knob as shown in FIG. 3, the gear 6 of large tooth form has been formed on the full outer periphery of the knob, and this has led to a problem that even if the tooth tops and end portion are endowed with a curvature, fingers can feel great pain when they operate the knob.

So, in order to mitigate the pain of the fingers, there has been adopted a construction as shown in FIG. 4 wherein the sheet feeding knob 7 is axially thick (great in width) and the gear portion 8 meshing with the gear of the cut sheet feeder and the knob portion 9 to be touched by the user (the portion to be touched by fingers) are formed separately from each other, or a construction in which the width of the gear portion 8 meshing with the gear of the cut sheet feeder is minimized and most of the knob is the knob portion 9.

However, in the sheet feeding knob 7 of great width, there have arisen problems in appearance and interchangeability (co-usability) and moreover, there has arisen a problem that the necessary space is large and the merit of utilizing the sheet feeding knob to transmit the drive force is eliminated and the difference from a case when a discrete transmission path is provided becomes small.

Also, in the construction wherein the width of the gear portion 8 is minimized, there have arisen problems in the mountability and dismountability thereof and the strength of the gear.

In addition, thick-walled portions are present adjacent to the portion such as the gear portion 8 which requires accuracy and therefore, there has arisen the problem of thinning when the knob is shaped in a mold, which has also led to a problem that accuracy cannot be maintained.

SUMMARY OF THE INVENTION

It is an object of the present invention to provide a cut sheet feeder which can effectively achieve automatic feeding and manual feeding of cut sheets and a recording apparatus using such a cut sheet feeder.

It is another object of the present invention to provide a recording apparatus or a cut sheet feeder in which no consideration need be given to the position of a pinch roller in the recording apparatus when the cut sheet feeder is mounted onto the recording apparatus.

It is still another object of the present invention to provide a recording apparatus in which the widthwise dimension can be minimized and which maintains the accuracy of the gear portion and yet is excellent in usability as a knob without involving any pain of fingers when they touch the knob.

DESCRIPTION OF THE PREFERRED EMBODIMENTS

Figure 1:
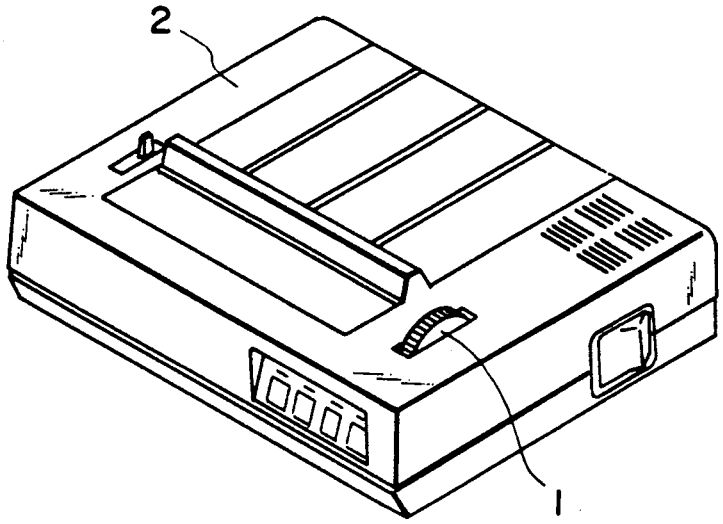
FIG. 1 is a pictorial perspective view showing an example of a recording apparatus having a sheet feeding knob.
Figure 2:
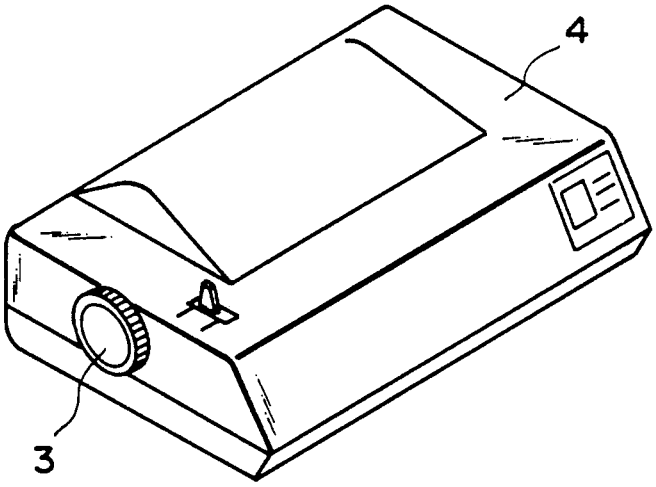
FIG. 2 is a pictorial perspective view showing another example of a recording apparatus having a sheet feeding knob.
Figure 3:
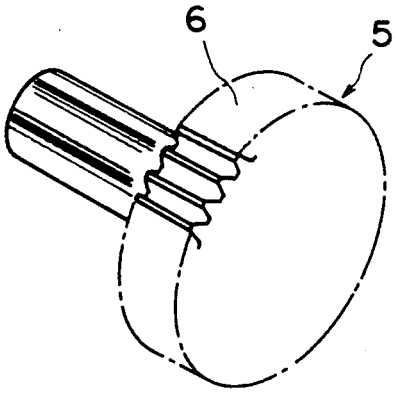
FIG. 3 is a perspective view showing an example of the conventional sheet feeding knob.
Figure 4:
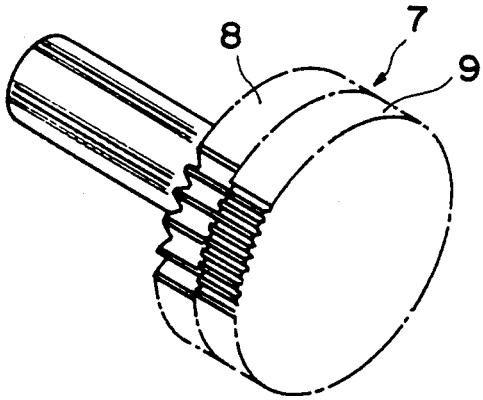
FIG. 4 is a perspective view showing another example of the conventional sheet feeding knob.
Figure 5:
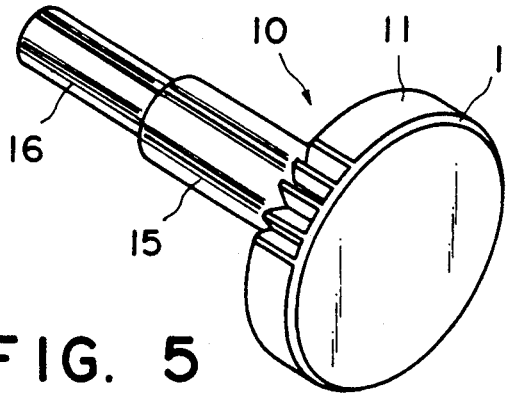
FIG. 5 is a perspective view showing an embodiment of a sheet feeding knob according to the present invention.
Figure 6:
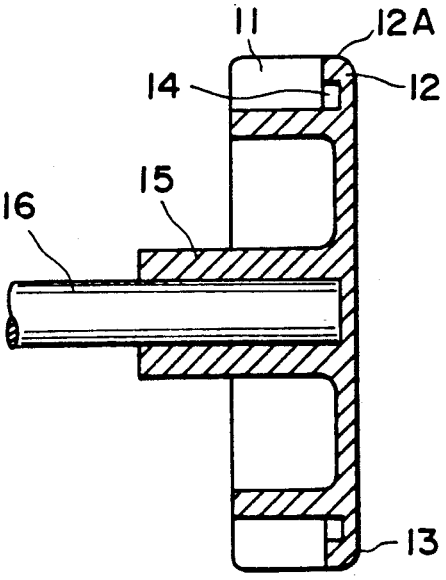
FIG. 6 is a central longitudinal cross-sectional view of the sheet feeding knob of FIG. 5.

FIG. 5 is a perspective view of a sheet feeding knob according to an embodiment of the present invention, and FIG. 6 is a central longitudinal cross-sectional view of the sheet feeding knob of FIG. 5.

Referring to FIGS. 5 and 6, a gear portion 11 for transmitting the feeder drive force from the drive source of a recording apparatus to the gear of an automatic sheet feeder is formed on the outer periphery of the sheet feeding knob 10 for manually operating the sheet feeding mechanism (a sheet feeding roller, etc.) of the recording apparatus.

A padding 12 as shown in FIG. 6 is provided on the end surface of the gear portion 11 on the finger-touch side (the outer side) thereof over the full circumference thereof, and a knob portion to be manually rotated by fingers is formed by the outer peripheral surface 12A of the padding 12.

In the illustrated example, the outer peripheral surface 12A of the padding 12 has the same diameter as the addendum circle of the gear portion 11.

The gear portion 11 is formed over the substantially full area approximate to the full width of the outer peripheral surface of the knob 10, and the knob portion 12A is formed over a minimum width (e.g. 1 mm to several mm). A chamfered or arcuate portion 13 is formed on the outer end portion of the knob portion 12A so that fingers may not feel any pain when they touch it.

Further, a lightening hole 14 as shown in FIG. 6 may be provided inside the padding 12 as required.

A boss portion 15 is formed on the central portion of the inner side of the sheet feeding knob 10, and a torque transmitting shaft 16 is fixed in the boss portion 15.

Thus, by the gear portion 11 being formed on the outer peripheral surface of the sheet feeding knob 10 and the padding 12 having the minimum necessary width and substantially the same outer diameter being provided on the outer end portion to be touched by fingers, there is constructed a sheet feeding knob equipped with both of the function as the original knob and the function as the power transmitting gear.

Figure 7:
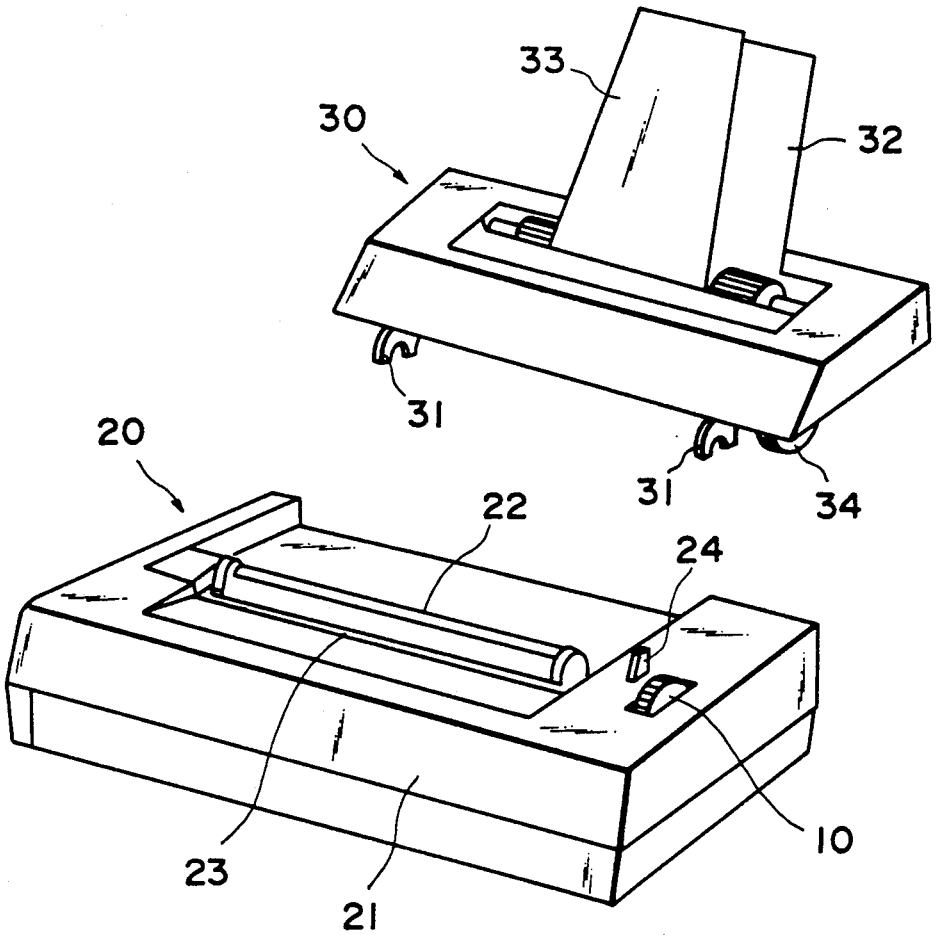
FIG. 7 is an exploded perspective view showing the manner in which an automatic sheet feeder is mounted on a recording apparatus having the sheet feeding knob according to the present invention.

FIG. 7 is an exploded perspective view showing the manner in which an automatic sheet feeder 30 is mounted on a recording apparatus 20 having the sheet feeding knob 10 according to the present invention.

In FIG. 7, the sheet feeding knob 10 is mounted in a half-embedded state in which it is incorporated into the body of the recording apparatus 20 and partly protruded from the upper surface of a case 21.

The upper surface of the recording apparatus 20 is formed with a sheet insertion port 22 and a sheet discharge port 23, and is further provided with a lever 24 for changing over the sheet conveyance mode to the manual insertion mode, the friction feed mode or the pin feed mode.

The bottom surface of the automatic sheet feeder 30 mounted on the recording apparatus 20 is provided with positioning and restraining metal fittings 31 and 31 for restraining the automatic sheet feeder at a predetermined position on the recording apparatus.

A sheet supply stacker 32 and a sheet discharge stacker 33 for piling and holding thereon sheets before supplied and sheets after discharged are provided on top of the automatic sheet feeder 30.

The automatic sheet feeder 30 is provided with a gear 34 for driving a sheet feed roller and a sheet discharge roller in the feeder. This gear 34 comes into meshing engagement with the gear portion 11 (FIGS. 5 and 6) of the sheet feeding knob 10 when the automatic sheet feeder 30 is set on the recording apparatus 20, and in the illustrated example, it is mounted in a half-embedded state so as to partly protrude from the bottom surface of the feeder 30.

Thus, the operating mechanism including the sheet feed roller and the sheet discharge roller in the automatic sheet feeder 30 may be driven by the power transmitted from a power source (a motor or the like) in the recording apparatus 20 through the sheet feeding knob 10.

According to the embodiment described above, the following operational effects can be attained.

(i) Since the width of the gear portion 11 can be designed sufficiently greatly with substantially the same width as the conventional sheet feeding knob maintained, the gear strength can be maintained and the ease of mounting and dismounting can be secured, and the space and appearance of the knob can be maintained substantially to the same degree as the ordinary knob.

(ii) The gear width can be sufficiently secured without increasing the full width of the sheet feeding knob, and at the same time, the configuration of the portion to be touched by fingers, i.e., the knob portion 12A, can be made excellent in usability in spite of its relatively narrow width.

(iii) Since the knob portion 12A is formed on the outer peripheral surface of the padding 12 formed on the end surface of the gear portion, the lightening hole 14 can be formed inside the padding 12 as required, and by selecting the padding 12 to a desired thickness, the thinning during the molding of the adjacent portion such as the gear portion 11 which requires accuracy can be prevented.

The amount of the material used can also be minimized.

A second embodiment of the present invention will now be described with reference to FIGS. 8 to 12. The present embodiment is such that when the cut sheet feeder is mounted on a recording apparatus, a pinch roller is forcibly urged.

Figure 8:
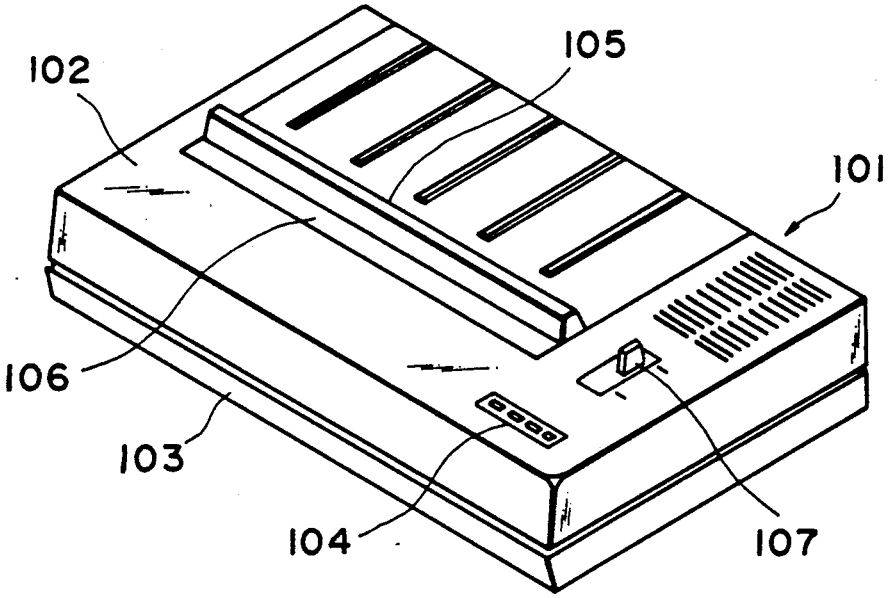
FIGS. 8 to 12 show another embodiment of the present invention, FIG. 8 being a perspective view of a recording apparatus to which the cut sheet feeder according to the present embodiment is connected, FIG. 9 being a fragmentary plan view of the release lever of FIG. 8, FIGS. 10A and 10B being schematic cross-sectional views respectively showing a state in which friction rollers are urged against a sheet feed roller and a state in which the friction rollers are spaced apart from the sheet feed roller, FIG. 11 being a side view showing the cut sheet feeder according to the present embodiment as mounted on the recording apparatus of FIG. 8, and FIG. 12 being a schematic longitudinal cross-sectional view showing a release lever setting mechanism in the present embodiment.

FIG. 8 shows the appearance of a recording apparatus (a printer) to which the cut sheet feeder according to the present embodiment is connected.

Referring to FIG. 8, the case of a recording apparatus 101 is comprised of an upper case portion 102 and a lower case portion 103, and the upper case portion is provided with an operating key 104, a sheet supply port 105, a sheet discharge port 106 and a release lever 107.

The release lever 107 is a lever for changing over the sheet feeding functions such as sheet friction feed and sheet pin feed.

Figure 9:
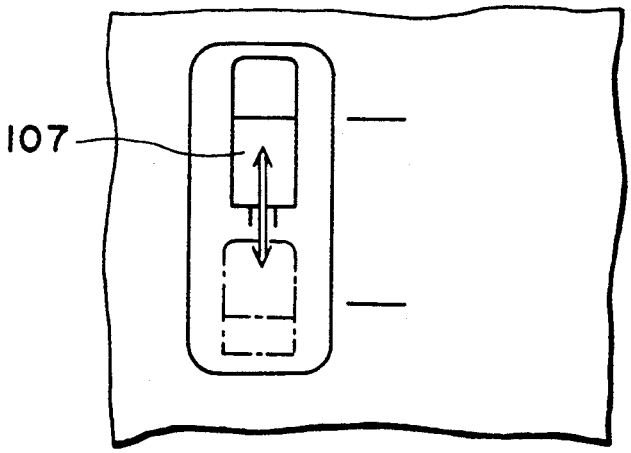

FIG. 9 is an enlarged view of the release lever 107 in FIG. 8.

In FIG. 9, when the release lever 107 is in a position indicated by solid line, the sheet feeding function of the recording apparatus is selected to the friction feed mode, and when the release lever 107 is in a position indicated by dots-and-dash line, the sheet feeding function of the recording apparatus is selected to the pin feed mode.

Figure 10A:
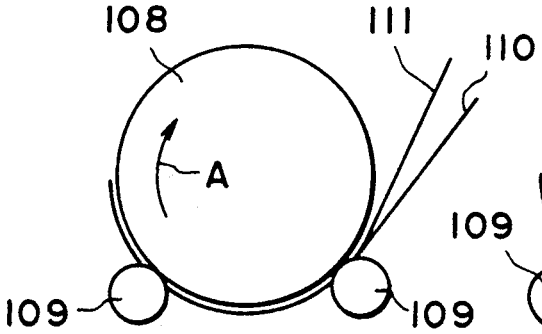
Figure 10B:
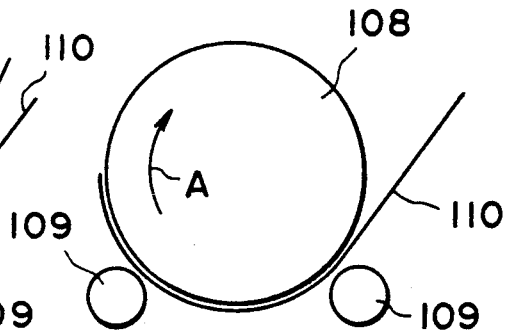

FIGS. 10A and 10B show the states of friction rollers (pinch rollers) in the friction feed mode and the pin feed mode, respectively, of the recording apparatus 101.

In the friction feed mode of FIG. 10A, friction rollers 109 and 109 are urged against a sheet feed roller 108, and a sheet 111 guided by a sheet guide 110 and fed into the portions of contact between the sheet feed roller 108 and the friction rollers 109, 109 is brought into intimate contact with the sheet feed roller 108 and is conveyed in the direction of rotation (arrow A) along the peripheral surface of the sheet feed roller 108 by a feeding force imparted by the urging force of the friction rollers 109 and 109.

The shown sheet feed roller 108 serves also as a platen roller, and a recording head (not shown) is disposed in opposed relationship with the peripheral surface of the sheet feed roller.

In the pin feed mode of FIG. 10B (or any other mode than the friction mode), the friction rollers 109 and 109 are spaced apart from the sheet feed roller 108 and even if the sheet 111 is supplied onto the peripheral surface of the sheet feed roller 108 as shown in FIG. 10A, no feeding force is produced in the sheet and the sheet remains stopped at that position and does not arrive at the recording station.

When the apparatus is used in the pin feed mode, a sheet with feed apertures such as a fan-folded sheet is fed in by a pin feed mechanism (not shown) comprising a sprocket or a pin tractor.

Figure 11:
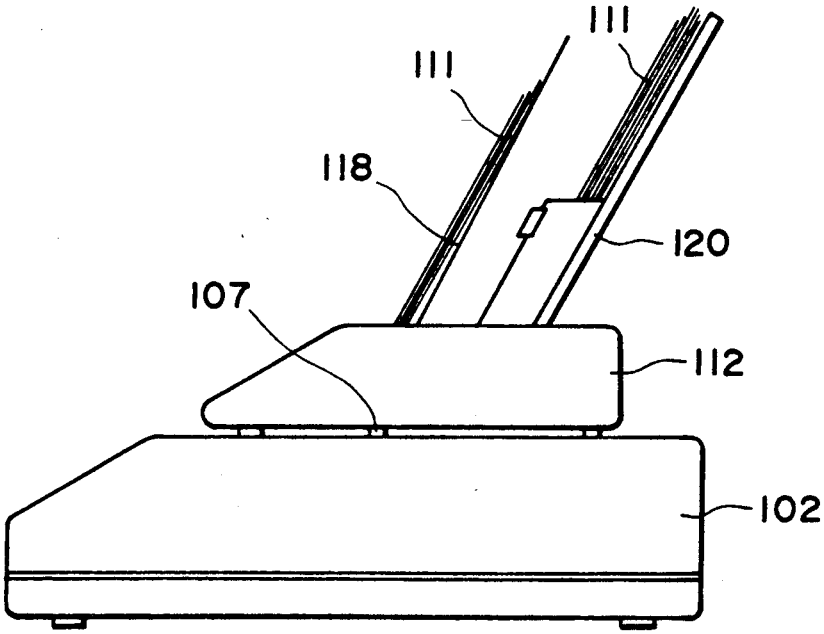

FIG. 11 shows a state in which a cut sheet feeder 112 is connected to (or mounted on) the case of the recording apparatus 101, and as shown, the release lever 107 is hidden in the feeder 112.

Figure 12:
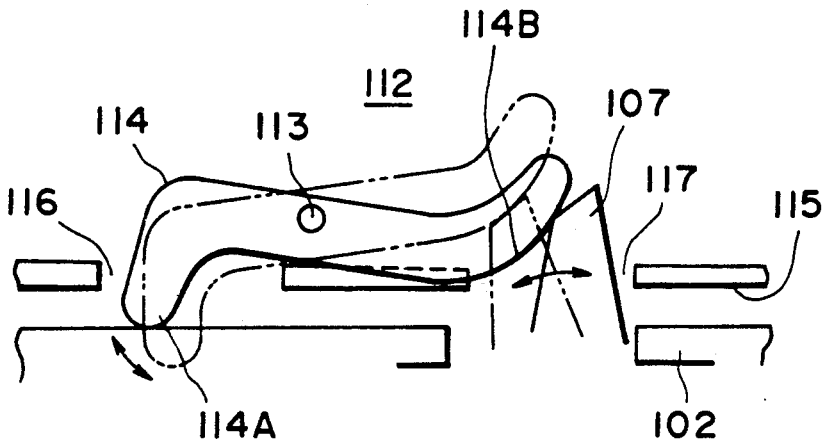

FIG. 12 illustrates the operation of the release lever 107 when the cut sheet feeder 112 is connected to the recording apparatus.

Referring to FIG. 12, a push rod 114 which is pivotable about a shaft 113 is supported in the cut sheet feeder 112, and the bottom surface 115 of the cut sheet feeder has formed therein an opening 116 for protruding therethrough one end portion 114A of the push rod 114, and an opening 117 for striking the release lever 107 against the other end portion 114B of the push rod 114 in the feeder 112 through the bottom surface 115 when the cut sheet feeder 112 is set at a predetermined connected position relative to the recording apparatus 101.

That is, when the cut sheet feeder 112 is placed at a predetermined position on the upper surface of the case 102 to connect it to the recording apparatus 101, one end portion 114A of the push rod 114 strikes against the case 102 and is thereby forcibly pivoted clockwise, and when the release lever 107 is in the other position (the position indicated by dots-and-dash line) such as the pin feed than the friction feed, the other end 114B of the push rod 114 urges the release lever to move it rightwardly as viewed in FIG. 12, thereby automatically changing over the release lever 107 to the friction feed mode.

When the release lever 107 is thus selected to the friction feed mode, the friction rollers 109 in the recording apparatus 101 are urged against the sheet feed roller 108 as shown in FIG. 10A and are set in a state in which they can convey a cut sheet. In such a state, when one of cut sheets 111 piled on the sheet supply tray 120 of the cut sheet feeder 112 as shown in FIG. 11 is fed through the sheet supply port 105 (FIG. 8) of the recording apparatus into the portions of pressure contact between the rotating sheet feed roller 108 and the friction rollers 109 being rotated by following the rotation of the sheet feed roller, the sheet 111 is reliably fed to a desired position while keeping intimate contact with the peripheral surface of the sheet feed roller 108 and passes through the recording station, whereafter it is again fed through the sheet discharge port 106 (FIG. 8) to the sheet stacker 118 (FIG. 11) of the cut sheet feeder 112 and piled thereon.

According to the above-described embodiment, there can be provided a cut sheet feeder in which no special drive source and sheet feed mode change-over output terminal are provided, but by merely setting the feeder 112 on the recording apparatus 101, the sheet feed mode can be reliably selected to the friction mode (feed mode).

Accordingly, even if the user forgets the position change of the release lever 107, it is possible to automatically change over the release lever to the position of a predetermined sheet feed mode and thus, there is provided a cut sheet feeder in which occurrence of the malfunctioning of the release lever 107 can be positively eliminated by a simple and relatively inexpensive construction and which can decrease the user's burden in handling.

Figure 13:
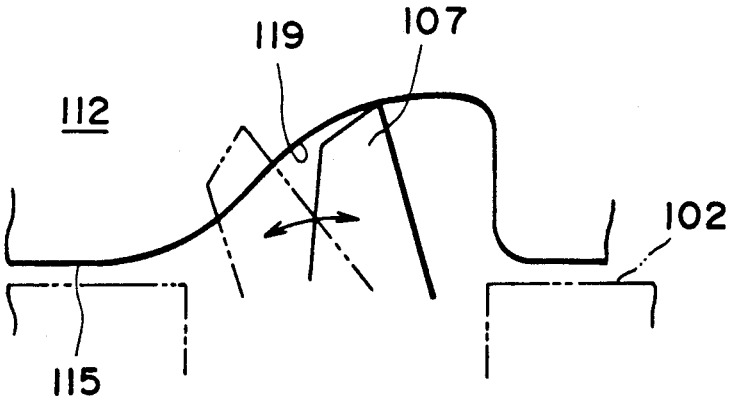
FIG. 13 is a schematic longitudinal cross-sectional view showing a release lever setting mechanism in still another embodiment of the present invention.

FIG. 13 shows the essential portions of a cut sheet feeder according to still another embodiment of the present invention.

In this embodiment, the bottom surface 115 of the cut sheet feeder 112 is formed with a cam surface 119 on which the release lever 107 is slidable so as to forcibly assume a predetermined position while bearing against the cam surface. That is, when the cut sheet feeder 112 is to be set on the recording apparatus 101, the release lever 107 may be forcibly (or automatically) set or moved to the position of a predetermined sheet feed mode (the friction feed mode) by the cam surface 119.

The present embodiment has a construction corresponding to a construction in which the push rod 14 in the embodiment of FIGS. 8–12 has been changed to the cam surface 119, and it is substantially the same as the embodiment of FIGS. 8–12 in the structure of the other portions than the essential portions shown in FIG. 13.

According to the present embodiment, there is provided a cut sheet feeder in which the same operational effects as those of the embodiment of FIGS. 8–12 are obtained and in addition, movable members such as the push rod, etc. can be omitted and which can further promote the reduction in the number of parts and the compactness of the apparatus.

Although in each of the above-described embodiments, design is made such that the friction mode or other mode is changed over through the release lever 107, the present invention is equally applicable to a case when without the intermediary of the release lever, setting to a desired sheet feed mode is accomplished directly by the position selection of another member for urging and spacing the friction rollers 109.

Figure 14:
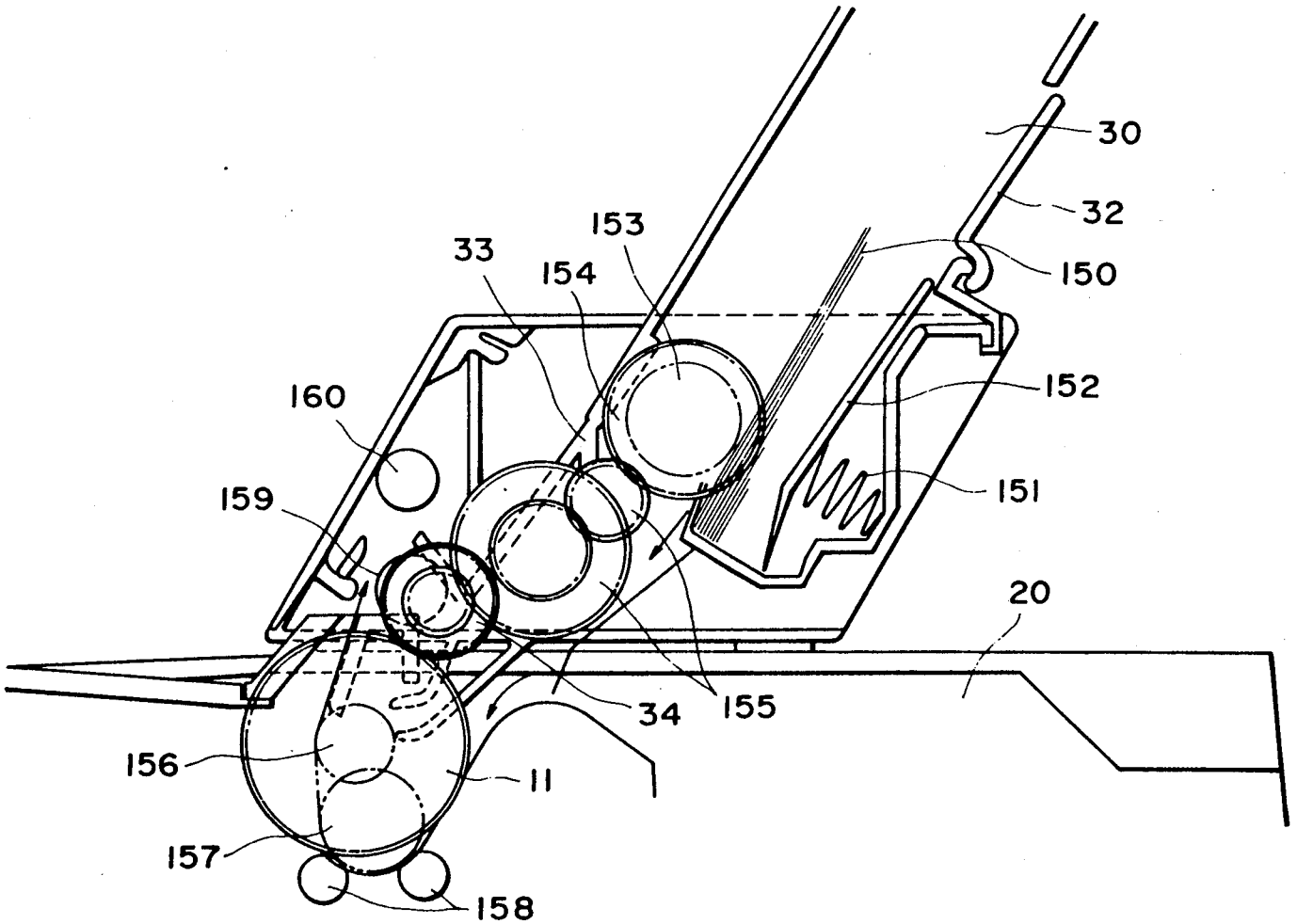
FIG. 14 illustrates a power transmitting mechanism in the embodiment of FIG. 7.

FIG. 14 illustrates the power transmission state of the cut sheet feeder 30 and the recording apparatus 20 to make the embodiment of FIG. 7 better understood. Cut sheets 150 in the sheet supply stacker 32 are pressed against a sheet feed roller 153 by a pressure plate 152 having its lower end biased by a spring 151.

A gear 154 is coaxially fixed to the sheet feed roller 153 and is connected to the gear 34 through a gear train 155. The gear 34 is in meshing engagement with the gear portion 11 coaxially fixed to a platen roller 156, as previously described. There is a sheet feed roller 157 below the platen roller 156 of the recording apparatus, and the rollers 156 and 157 are rotated by a motor, not shown, through a gear train (not shown). A pinch roller 158 is urged against the sheet feed roller 157 in such a manner that it cannot be spaced apart from the latter.

On the other hand, a sheet discharge roller 159 is rotatively driven by the gear 34 through a gear, not shown. Designated by 160 is a controlling roller which does not directly contact the sheet discharge roller 159, but holds down the upper surface of a cut sheet fed from the platen roller 156 and firmly presses the sheet against the sheet discharge roller 159 by the rigidity of the sheet itself. Reference numeral 33 denotes a sheet discharge stacker.

I claim:

1. A recording system comprising:

a recording apparatus for effecting a record on a sheet; and a sheet feeder for feeding a sheet to said recording apparatus;

said recording apparatus having a platen roller for transferring the sheet, a pinch roller to be engaged to or disengaged from said platen roller, a manual knob for manually driving said platen roller; and moving means for moving said pinch roller to a position to be engaged with said platen roller and a position to be not engaged with said platen roller, whereby said sheet feeder has feeding means for feeding a sheet and drive force transmitting means for receiving a drive force from said recording apparatus through a gear portion to drive said sheet feeder when said sheet feeder is mounted on said recording apparatus, and wherein said sheet feeder further has an engaging member for engaging with said moving means when said sheet feeder is mounted on said recording apparatus to move said moving means in order to move said pinch roller.

2. A recording system according to claim 1, wherein said knob has a knob gear portion at a periphery thereof and a flat portion having the same diameter as that of the addendum circle of said knob gear portion.

3. A system according to claim 1, wherein said moving means comprises a manually operable lever.

4. A recording system comprising:

a recording apparatus for effecting a record on a sheet, said recording apparatus including a platen roller for transferring the sheet, a pinch roller to be engaged to or disengaged from said platen roller, and moving means for moving said pinch roller to a position to be engaged with said platen roller and a position to be not engaged with said platen roller; and a sheet feeder for feeding the sheet to said recording apparatus, said sheet feeder being removably mountable on said recording apparatus in a mounting operation, wherein said sheet feeder has feeding means for feeding the sheet and an engaging member for engaging with said moving means, and wherein, when said sheet feeder is mounted on said recording apparatus in the mounting operation, said sheet feeder is moved toward said recording apparatus so that said engaging member engages with said moving means to actuate said moving means and move said pinch roller to said platen roller in a direction to engage said pinch roller with said platen roller.

5. A recording system according to claim 4, wherein said sheet feeder feeds individual sheets one by one from a stack of sheets.

6. A recording system according to claim 4, wherein said moving means has a first lever for moving said pinch roller.

7. A recording system according to claim 6, wherein said engaging member has a cam surface formed on the bottom of said sheet feeder and said first lever engage said cam surface when said sheet feeder is mounted on said recording apparatus in the mounting operation to move said pinch roller.

8. A recording system according to claim 6, wherein said engaging member has rotatable second lever, and one end of said second lever engages said recording apparatus when said sheet feeder is mounted on said recording apparatus and another end of said second lever engages said first lever and said second lever rotates to actuate said first lever to move said pinch roller.

9. A recording system according to claim 4, wherein said engaging member is provided on the bottom of said sheet feeder.

10. A system according to claim 4, wherein said moving means comprises a manually operable lever.

* * * * *

UNITED STATES PATENT AND TRADEMARK OFFICE

CERTIFICATE OF CORRECTION

PATENT NO. : 5,129,646

DATED : July 14, 1992

INVENTOR(S) : AKIRA MIYAKAWA

It is certified that error appears in the above-identified patent and that said Letters Patent is hereby corrected as shown below:

In the Drawings:

FIGURE 5:

"1" should read --13--.

COLUMN 6:

Line 16, "supplied" should read --being supplied--; and "discharged" should read --being discharged--.

COLUMN 10:

Line 38, "engage" should read --engages--;

Line 43, "rotatable" should read --a rotatable--.

Signed and Sealed this

Fourteenth Day of September, 1993

Bruce Lehman

*Attest:*

BRUCE LEHMAN

*Attesting Officer*

*Commissioner of Patents and Trademarks*